US010322848B2

(12) United States Patent
Kapoor

(10) Patent No.: US 10,322,848 B2
(45) Date of Patent: Jun. 18, 2019

(54) CUSTOMIZABLE PALLET

(71) Applicant: Asheer Kapoor, Pune (IN)

(72) Inventor: Asheer Kapoor, Pune (IN)

( * ) Notice: Subject to any disclaimer, the term of this patent is extended or adjusted under 35 U.S.C. 154(b) by 0 days.

(21) Appl. No.: 15/542,142

(22) PCT Filed: Jul. 29, 2016

(86) PCT No.: PCT/IN2016/050255

§ 371 (c)(1),
(2) Date: Jul. 7, 2017

(87) PCT Pub. No.: WO2017/125942

PCT Pub. Date: Jul. 27, 2017

(65) Prior Publication Data

US 2018/0044058 A1 Feb. 15, 2018

(30) Foreign Application Priority Data

Jan. 20, 2016 (IN) ..... 201621002075

(51) Int. Cl.
*B65D 19/00* (2006.01)

(52) U.S. Cl.
CPC .. *B65D 19/0095* (2013.01); *B65D 2519/0099* (2013.01); *B65D 2519/00273* (2013.01); *B65D 2519/00293* (2013.01); *B65D 2519/00323* (2013.01); *B65D 2519/00333* (2013.01); *B65D 2519/00572* (2013.01); *B65D 2519/00766* (2013.01); *B65D 2519/00985* (2013.01)

(58) Field of Classification Search
CPC ..... B65D 19/00; B65D 2519/00547; B65D 2519/00552; B65D 2519/00572
USPC ..... 108/56.1, 51.1, 54.1, 51.11
See application file for complete search history.

(56) References Cited

U.S. PATENT DOCUMENTS 2,405,535 A * 8/1946 Weiss ..... B65D 19/38 108/54.1
2,739,776 A * 3/1956 Terando ..... B65D 19/0002 108/54.1
2,764,377 A * 9/1956 Schoenecker ..... B65D 19/0095 108/54.1

(Continued)

FOREIGN PATENT DOCUMENTS

EP 2896582 7/2015
KR 100656290 B1 10/1995

OTHER PUBLICATIONS

International Search Report and Written Opinion, International Patent Application No. PCT/IN2016/050255 (6 pages).

*Primary Examiner* — Jose V Chen
(74) *Attorney, Agent, or Firm* — Hamre, Schumann, Mueller & Larson, P.C.

(57) ABSTRACT

A customizable pallet is disclosed that includes a plurality of length members, and a plurality of width members that are connected through a plurality of connecting members. Each length member includes a plurality of circular projections having a first circular holder positioned therein. Each first circular holder has a circular groove defined therein. Each width member includes a plurality of circular grooves having a second circular holder positioned therein. The second circular holder has a circular projection defined therein. The connecting members facilitate connection between the circular projections of the width members and the circular grooves of the length members.

13 Claims, 7 Drawing Sheets

(56) References Cited

U.S. PATENT DOCUMENTS

| | | | | | |
|---|---|---|---|---|---|
| 2,828,931 | A * | 4/1958 | Harvey | B65D 19/0095 | 108/54.1 |
| 2,922,606 | A * | 1/1960 | Glassman | B65D 19/0095 | 108/56.1 |
| 2,942,827 | A * | 6/1960 | Edson | B65D 19/0028 | 108/54.1 |
| 3,022,028 | A * | 2/1962 | Reinhard | F16M 5/00 | 108/56.1 |
| 3,329,103 | A * | 7/1967 | Cohen | B65D 19/0095 | 108/54.1 |
| 3,651,769 | A * | 3/1972 | Foley | B65D 19/0073 | 108/52.1 |
| 4,822,066 | A * | 4/1989 | Rehrig | B60B 33/0002 | 108/56.1 |
| 5,007,352 | A * | 4/1991 | Calkoen | B65D 19/0059 | 108/56.1 |
| 5,351,628 | A * | 10/1994 | Breezer | B65D 19/0022 | 108/56.1 |
| 5,461,988 | A | 10/1995 | Cummings et al. | | |
| 7,455,017 | B2 * | 11/2008 | Carpenter | B65D 81/054 | 108/51.11 |
| 7,959,059 | B2 * | 6/2011 | Tamamori | B65D 19/44 | 108/54.1 |
| 9,206,827 | B2 | 12/2015 | Loree et al. | | |
| 2002/0100396 | A1 * | 8/2002 | Richard | B62B 5/0083 | 108/54.1 |
| 2005/0081763 | A1 * | 4/2005 | Ramirez von Holle | B65D 19/0026 | 108/56.1 |

* cited by examiner

CUSTOMIZABLE PALLET

FIELD OF THE INVENTION

The present invention relates to pallets for handling and storage of goods and more particularly, to a customizable pallet adapted to be configured into various shapes per user's requirement.

BACKGROUND OF THE INVENTION

Package handling and storing is one of the tedious and time taking tasks in various industries. Goods to be handled include raw material required for manufacturing or production as well finished products. Production area and warehouses implement various methods and techniques for handling and storing the goods such as overhead transportation systems, conveyors, metal or wood frame structures and the like.

The current systems used for storing and handling goods involve fabricated structures generally of fixed shapes and sizes. These structures occupy large space and they cannot be dissembled when not in use. Various attempts have been made to develop user friendly and less rigid systems for storing and handling goods. For example U.S. Pat. No. 9,206,827 discloses a wall mount organization system that includes horizontal slots, drawers, hooks and like. The system including listed features may be detachably mounted on the wall. Another patent application number EP2869582A1 discloses a transelevator for handling pallets, and goods storage system. The system includes fixed frames rotatable in X and Y planes and movable in Z axis plane. These frames are moved and rotated by geared motors. The frames and structures for storing and handling goods cited in the prior art are of fixed shape and sizes. These structures though are movable and detachable cannot be assembled or dissembled in the shapes and sizes as per the user's need. The frames occupy large storing space even when not in use and involve transportation cost while carried back to the shipping stations from delivery stations. It also involves man power in addition with automation for management of such structures.

Accordingly there is need of structures that can be easily assembled at destination and dissembled when not in use as per user's requirement and reusable facilitating cost saving of transportation and manufacturing.

SUMMARY OF THE INVENTION

The present invention relates to a customizable pallet adapted to be formed in various shapes such as square, triangle, trapezoidal and the like. The customizable pallet mainly includes a plurality of length members and a plurality of width members. The length and width members of the present invention respectively have various sizes in order to facilitate various shapes to the customizable pallet.

The length member has a plurality of circular projections extending from a top surface thereof up to a predefined height. In addition, the circular projections inwardly extend within the length member up to a bottom surface thereof. Each of the circular projections has a first circular holder positioned therein at a predefined distance from the bottom surface thereof. The first circular holder includes a circular groove defined therein.

The width member has a plurality of circular grooves inwardly extending between a top surface and a bottom surface thereof. Each of the circular grooves has a second circular holder positioned therein at a predefined distance from top surface thereof. The second circular holder includes a circular projection defined therein. It is understood here that the number of projections and grooves may vary per dimensions of the length and width members respectively. The position of projections and grooves may substantially vary per the dimensions of length and width members in accordance with the present invention.

DETAILED DESCRIPTION OF DRAWINGS

Figure 1:
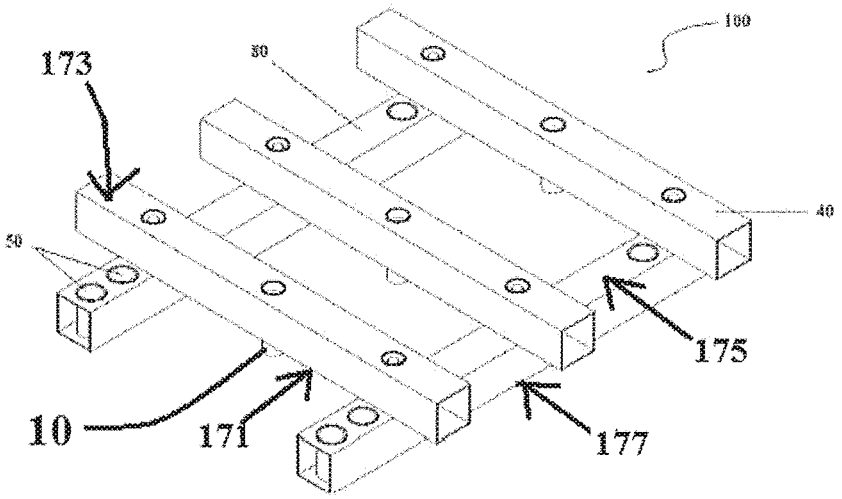
FIG. 1 is a perspective view of a customizable pallet, in accordance with the present invention.

Although specific terms are used in the following description for sake of clarity, these terms are intended to refer only to particular structure of the invention selected for illustration in the drawings, and are not intended to define or limit the scope of the invention.

References in the specification to "one embodiment" or "an embodiment" members that a particular feature, structure, characteristic, or function described in connection with the embodiment is included in at least one embodiment of the invention. The appearances of the phrase "in one embodiment" in various places in the specification are not necessarily all referring to the same embodiment.

Figure 2:
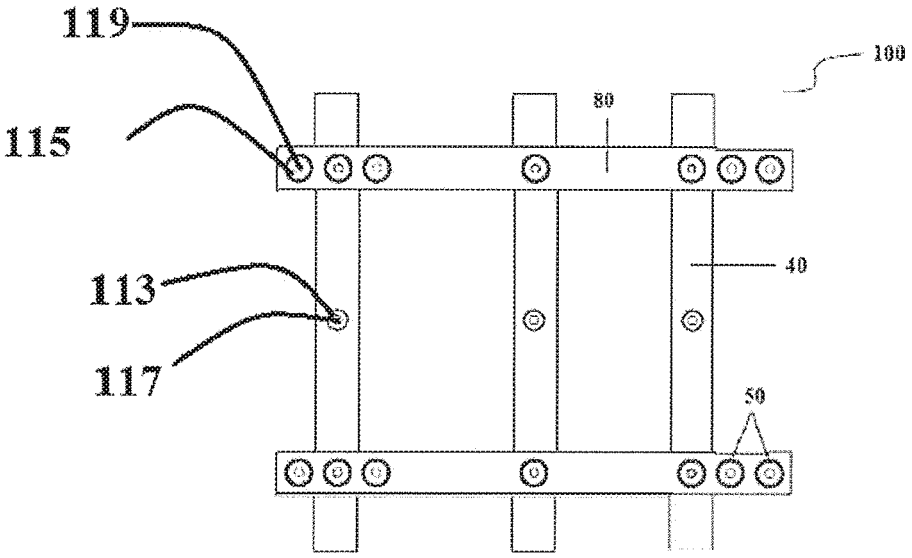
FIG. 2 is a top view of the customizable pallet of FIG. 1.
Figure 3:
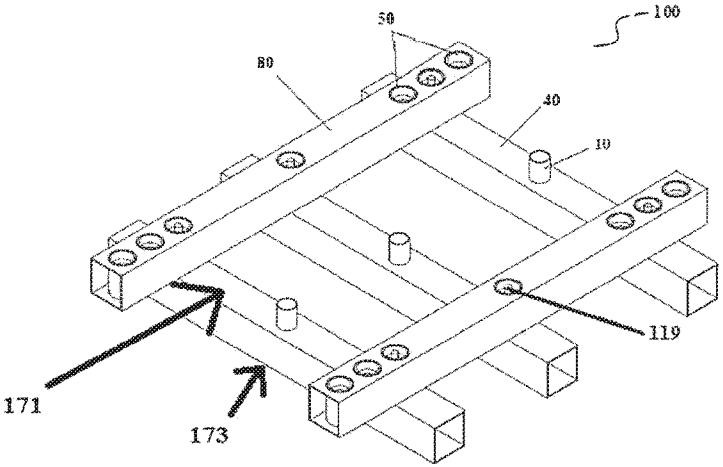
FIG. 3 is a bottom perspective view of the customizable pallet of FIG. 1.

Referring to FIG. 1-3, a customizable pallet (100) in accordance with a preferred embodiment of the present invention is shown. In this preferred embodiment, the customizable pallet (100) includes a plurality of length members (40) (hereinafter "the length members (40)") and a plurality of width members (80) (hereinafter "the length members (80)"). The length and width members (40, 80) of the present invention respectively have various sizes in order to facilitate various shapes to the customizable pallet (100). In this one embodiment, the customizable pallet (100) is adapted to form square shape. However, it is understood that the customizable pallet (100) may be adapted to get configured into various shapes such as triangle, trapezoidal and the like per user's requirement.

Each length member (40) has a plurality of circular projections (10) extending from a top surface (171) thereof up to a predefined height. In addition, the circular projections (10) inwardly extend within the length member (40) up to a bottom surface (173) thereof. Each of the circular projections (10) has a first circular holder (113) positioned therein at a predefined distance (D1) from the bottom surface (173) thereof. The first circular holder (113) includes a circular groove (117) defined therein.

Each width member (80) has a plurality of circular grooves (50) inwardly extending between a top surface (177) and a bottom surface (175) thereof. Each of the circular grooves has a second circular holder (115) positioned therein at a predefined distance (D2) from top surface (177) thereof. The second circular holder (115) includes a circular projection (119) defined therein. The width members (80) are positioned on the length members (40) in such a way that the plurality of circular projections (10) of the length members (40) gets inserted into plurality of circular grooves (50) of the width members (80) thereby allowing alignment of the first holder (113) on the second holder 015). The length members (40) and the width members (80) are fixed in position using connecting members such as a bolted connection formed out of nuts and bolts so as to form smooth top surface (171, 177) of the customizable pallet (100) that facilitates carrying of the goods without any obstructions.

Each of the length members (40) has a predefined length L1. Each of the width members (80) has a predefined length L2. It is understood however that the predefined lengths L1 and L2 may vary per customization requirement of the pallet. The predefined length L1 of the length member (40) is selected from 350 mm, 750 mm, 1350 mm, 1900 mm, 2500 mm and 3000 mm. The predefined length L2 of the width member (80) is selected from 486 mm, 846 mm, 1334 mm and 1686 mm.

It is understood here that the number of projections and grooves may vary per dimensions of the length and width members respectively. The position of projections and grooves may substantially vary per the dimensions of length and width members in accordance with the present invention.

Figure 4:
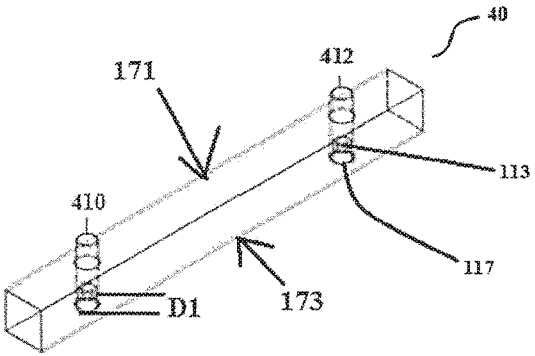
FIG. 4-9 show perspective views of different length members of the customizable pallet, in accordance with the present invention.

Various embodiments of the length and width members (40, 80) are described hereinafter Referring to FIGS. 1 and 4, the length member (40), having predefined length L1 of 350 mm, preferably includes two projections (410, 412) such that each projection (410, 412) is spaced apart at a fixed distance from centre of the length member (40).

Figure 5:
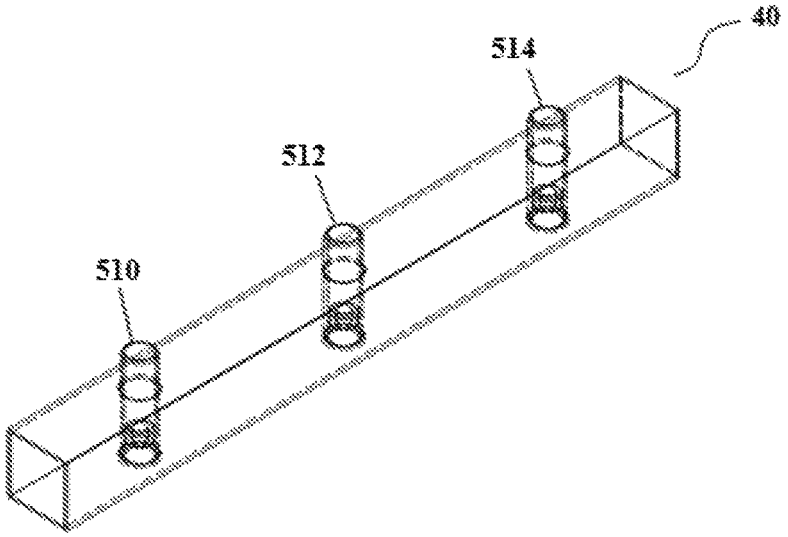

Referring to FIGS. 1 and 5, the length member (40), having predefined length L1 of 750 mm, preferably includes three projections (510, 512 and 514) such that one of the projections (512) is centrally located along the length member (40) and remaining two projections (510, 514) are equally spaced apart at a predefined distance from said central projection (512).

Figure 6:
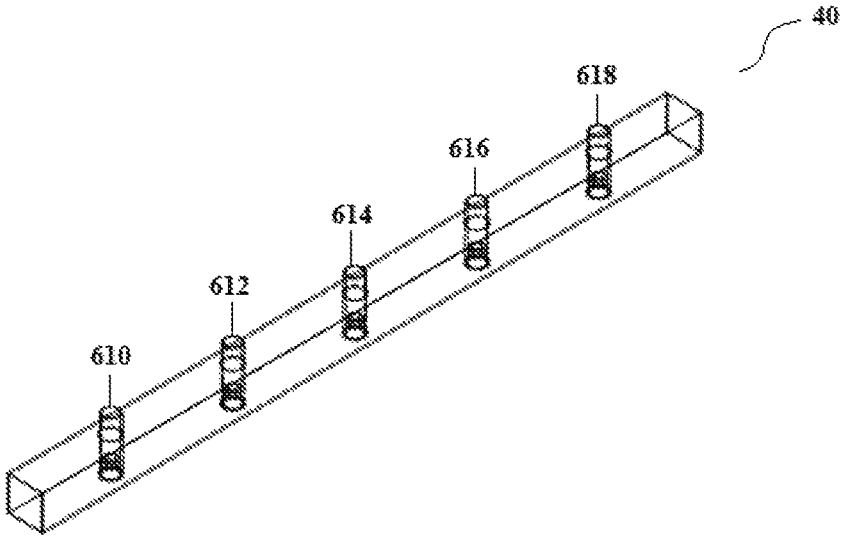

Referring to FIGS. 1 and 6, the length member, having predefined length L1 of 1350 mm, preferably includes five projections (610, 612, 614, 616 and 618) such that one of the projections (614) is centrally located along the length member (40) and remaining four projections (610 612, 616 and 618) are equally spaced apart from said central projection (614).

Figure 7:
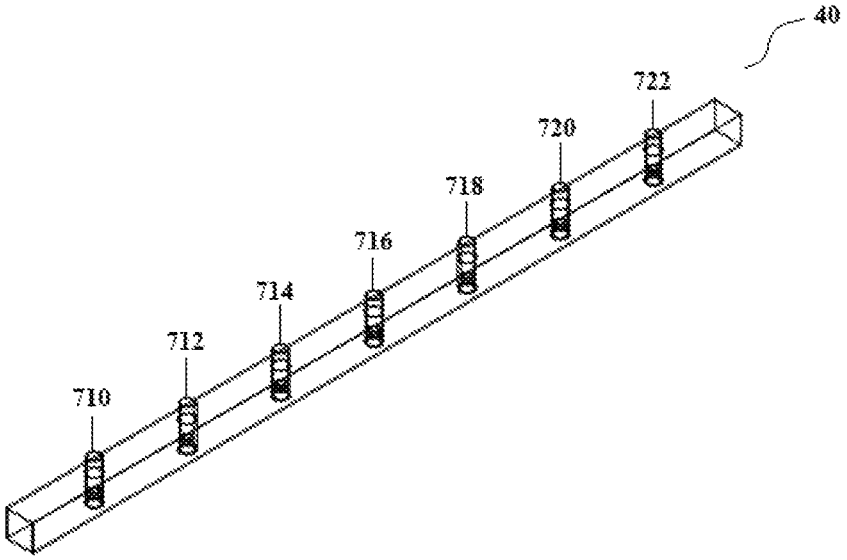

Referring to FIGS. 1 and 7, the length member (40), having predefined length L1 of 1900 mm, preferably includes seven projections (710, 712, 714, 716, 718, 720 and 722) such that one of the projections (716) is centrally located along the length member (40) and remaining six projections (710, 712, 714, 718, 720 and 722) are equally spaced apart from said central projection (716).

Figure 8:
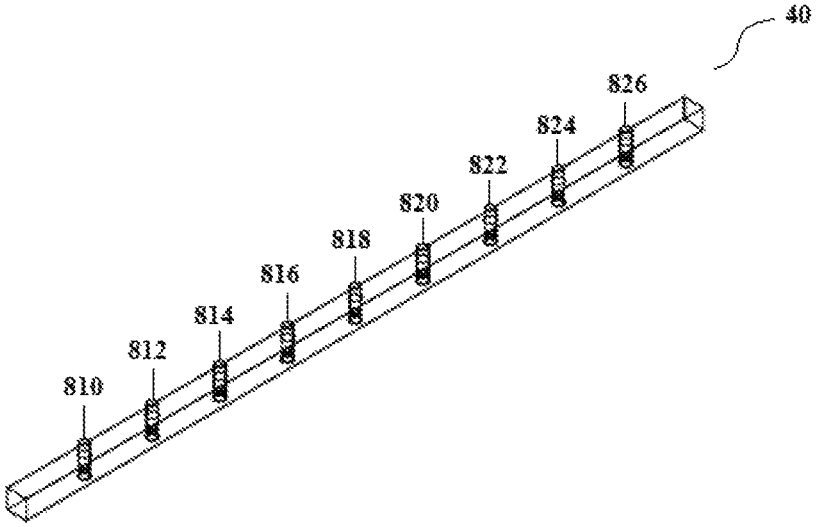

Referring to FIGS. 1 and 8, the length member (40), having predefined length L1 of 2500 mm, preferably includes nine projections (810, 812, 814, 816, 818, 820, 822, 824 and 826) such that one of the projections (818) is centrally located along the length member (40) and remaining eight projections (810, 812, 814, 816, 820, 822, 824 and 826) are equally spaced apart from said central projection (818).

Figure 9:
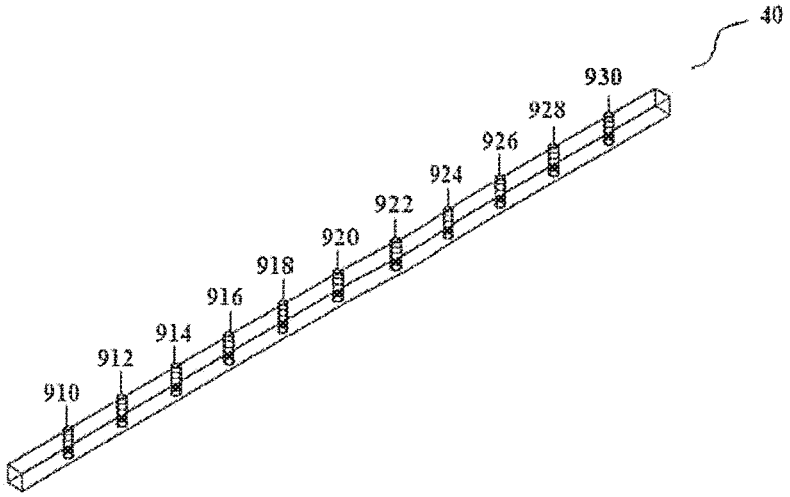

Referring to FIGS. 1 and 9, the length member (40), having predefined length L1 of 3000 mm, preferably includes eleven projections (910, 912, 914, 916, 918, 920, 922, 924, 926, 928 and 930) such that one of the projections (920) is centrally located along the length member (40) and remaining ten projections (910, 912, 914, 916, 918, 922, 924, 926, 928 and 930) are equally spaced apart from said central projection (920).

Figure 10:
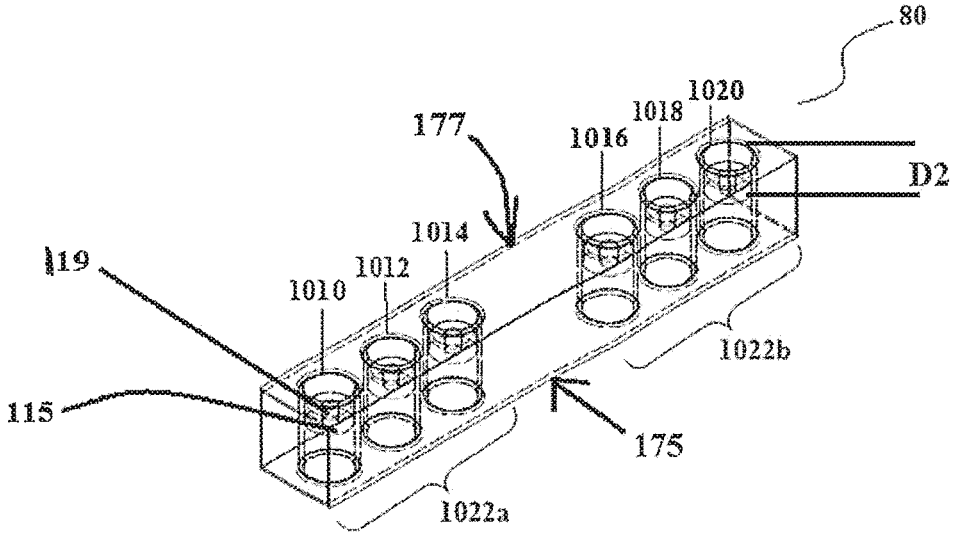
FIG. 10-13 show perspective views of different width members of the customizable pallet, in accordance with the present invention.

Referring to FIGS. 1 and 10, the width member (80), having predefined length L2 of 486 mm, preferably includes six grooves (1010, 1012, 1014, 1016, 1018 and 1020) defined in form of two sets of (1022*a*, 1022*b*) grooves such that each set of grooves (1022*a*, 1022*b*) preferably includes three grooves. The grooves in each set of grooves (1022*a*, 1022*b*) are equally spaced apart from each other. The two sets of grooves (1022*a*, 1022*b*) are equally spaced apart from a center of the width member (80).

Figure 11:
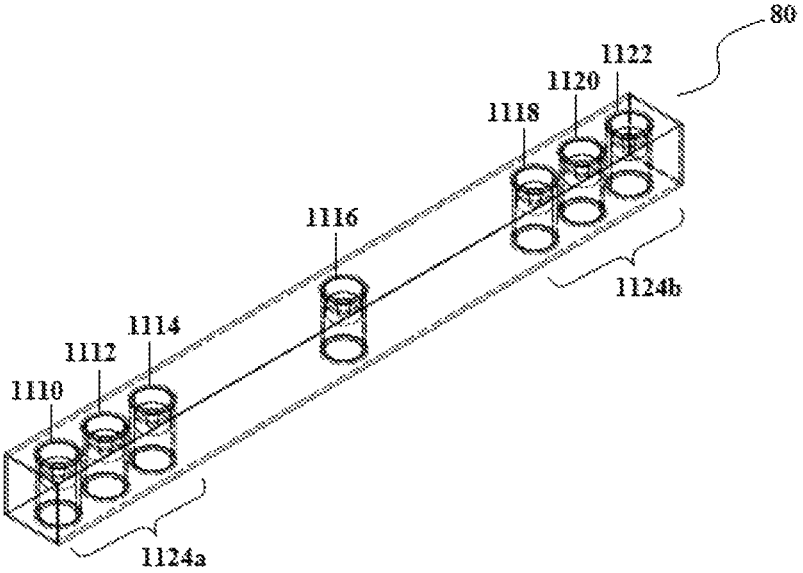

Referring to FIGS. 1 and 11, the width member, having predefined length L2 of 846 mm, preferably includes seven grooves (1110, 1112, 1114, 1116, 1118, 1120 and 1122) defined in form of one central groove (1116) and two sets of grooves (1124*a*, 1124*b*) . The central groove is located (1116) at a center of the width member (80). Each set of grooves (1124*a*, 1124*b*) preferably includes three grooves. The grooves in each set (1124*a*, 1124*b*) are equally spaced apart from each other. The two sets of grooves (1124*a*, 1124*b*) are equally spaced apart from the central groove (1116).

Figure 12:
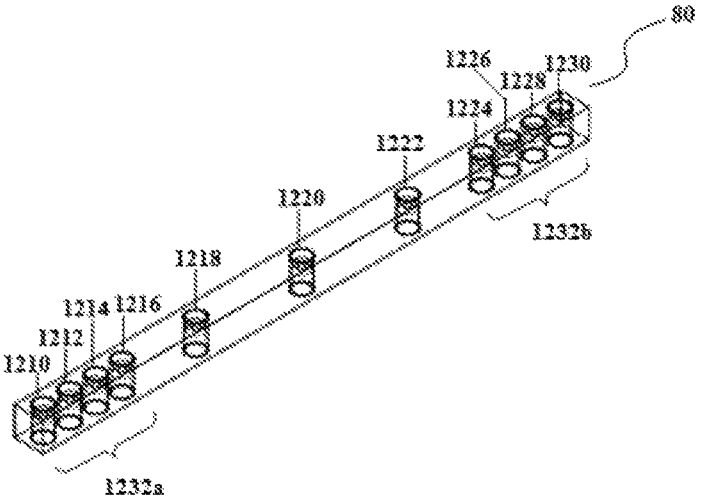

Referring to FIGS. 1 and 12, the width member (80), having predefined length L2 of 1334 mm, preferably includes eleven grooves (1210, 1212, 1214, 1216, 1218, 1220, 1222, 1224, 1226, 1228 and 1230) defined in form of one central groove (1220), two adjacent grooves (1218, 1222) and two sets of grooves (1232*a*, 1232*b*) . The central groove (1220) is located at a center of the width member (80). Each adjacent groove (1218, 1222) is equally spaced apart from the central groove (1220). Each set of grooves (1234*a*, 1234*b*) preferably includes four grooves. The grooves in each set (1234*a*, 1234*b*) are equally spaced apart from each other. The two sets of grooves (1234*a*, 1234*b*) are equally spaced apart from the two adjacent grooves (1218, 1222) respectively.

Figure 13:
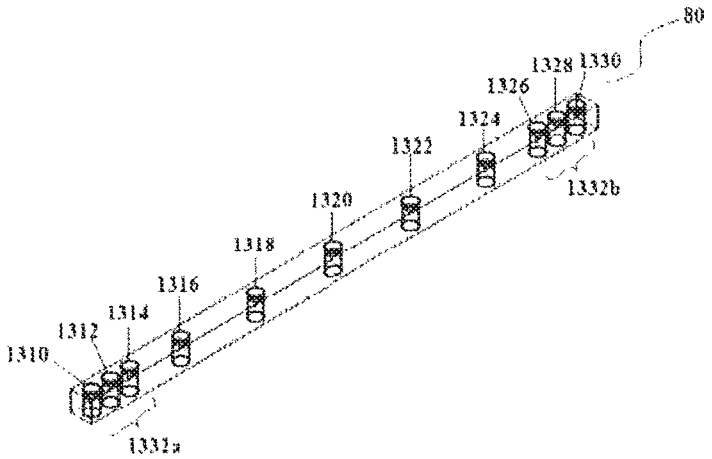

Referring to FIGS. 1 and 13, the width member (80), having predefined length L2 of 1686 mm, preferably includes eleven grooves (1310, 1312, 1314, 1316, 1318, 1320, 1322, 1324, 1326, 1328 and 1330) defined in form of one central groove (1320), four adjacent grooves (1316, 1318, 1322, 1324) and two sets of grooves (1332*a*, 1332*b*) . The central groove (1320) is located at a center of the width member (80). Each two adjacent grooves (1316, 1318 and 1322, 1324) are equally spaced apart from the central groove (1320). Each set of grooves (1332*a*, 1332*b*) preferably includes three grooves. The grooves in each set (1332*a*, 1332*b*) are equally spaced apart from each other. The two sets of grooves (1332*a*, 1332*b*) are equally spaced apart from the outermost adjacent grooves respectively.

Figure 14:
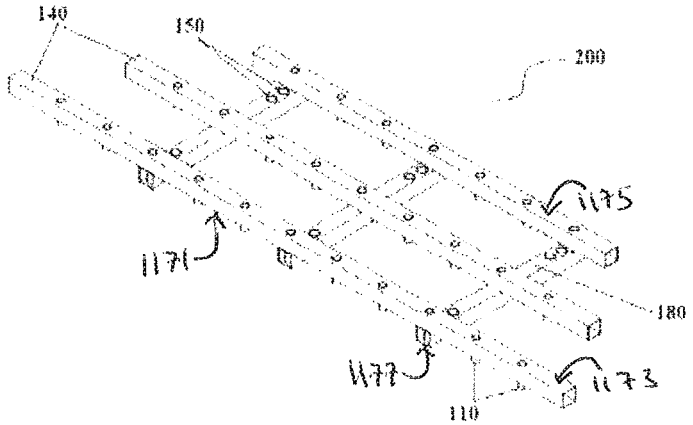
FIG. 14 shows a top perspective view of a customizable pallet, in accordance with an alternate embodiment of the present invention.

Now referring to FIG. 14, a customizable pallet (200) in accordance with another embodiment of the present invention is shown. In this another embodiment, the customizable pallet (200) includes a plurality of length members (140) (hereinafter "the length members (140)") and a plurality of width members (180) (hereinafter "the length members (180)"). The length and width members (140, 180) of the present invention respectively have various sizes in order to facilitate various shapes to the customizable pallet (200). In this one embodiment, the plurality of width members is positioned on the plurality of length members such as to form a trapezoidal shape of the customizable pallet (200). However, it is understood that the customizable pallet (100)

may be adapted to get configured into various shapes such as square, triangle and the like per user's requirement.

Each length member (140) has a plurality of circular projections (110) extending from a top surface (1171) thereof up to a predefined height. In addition, the circular projections (110) inwardly extend within the length member (140) up to a bottom surface (1173) thereof. Each of the circular projections (110) has a first circular holder (not shown) positioned therein at a predefined distance from the bottom surface (1173) thereof. The first circular holder includes a circular groove not shown) defined therein.

Each width member (180) has a plurality of circular grooves (150) inwardly extending between a top surface (1177) and a bottom surface (1175) thereof. Each of the circular grooves (150) has a second circular holder (not shown) positioned therein at a predefined distance from top surface (1177) thereof. The second circular holder includes a circular projection (not shown) defined therein. In this one embodiment the length members (140) are placed in gradually decreasing length. The width members (180) are positioned on the length members (140) in such a way that the plurality of circular projections (110) of the length members (140) gets inserted into plurality of circular grooves (150) of the width members (180) thereby allowing alignment of the first circular holder on the second circular holder. The length members (140) and the width members (180) are fixed in position using connecting members such as nuts and bolts so as to form smooth top surface (1171, 1177) of the customizable pallet (200) that facilitates carrying of the goods without any obstructions.

ADVANTAGES OF THE INVENTION

1) The customizable pallet (100) allows dismantling and reassembly of the members thereby reducing space required as well as transportation cost.
2) The customizable pallet (100) facilitates different combinations of the length and width members to adjust size of the pallet depending on requirement.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching.

The embodiments were chosen and described in order to best explain the principles of the present invention and its practical application, to thereby enable others, skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the present invention.

The invention claimed is:

1. A customizable pallet comprising:

a plurality of length members, each length member having a plurality of circular projections defined along a top surface thereof, the circular projections outwardly extending from the top surface of the length member, the circular projections partly inwardly extending within the length member, each of the circular projections having a first circular holder positioned therein; each first circular holder having a circular groove defined therein;

a plurality of width members, each width member having a plurality of circular grooves inwardly extending between a top surface and a bottom surface thereof, each of the circular grooves having a second circular holder positioned therein, the second circular holder having a circular projection defined therein; and a plurality of connecting members, each of the connecting members facilitating connection between the circular projections of the width members and the circular grooves of the length members, wherein, the circular projections of the length members positioning into the circular grooves of the width members thereby facilitating alignment of the first circular holder on the second circular holder.

2. The customizable pallet as claimed in claim 1, wherein the connecting member is a bolted connection.

3. The customizable pallet as claimed in claim 1, wherein the connecting member facilitates a smooth top surface to carry goods without any obstructions.

4. The customizable pallet as claimed in claim 1, wherein the length member has a predefined length selected from 350 mm, 750 mm, 1350 mm, 1900 mm, 2500 mm and 3000 mm.

5. The customizable pallet as claimed in claim 1, wherein the customizable pallet as claimed in claim 1, wherein the width member has a predefined length selected from 486 mm, 846 mm, 1334 mm and 1686 mm.

6. The customizable pallet as claimed in claim 1, wherein each of the plurality of circular projections are equally spaced apart at a fixed distance from a central projection on each of the plurality of length members, and each of the plurality of grooves are equally spaced apart at a fixed distance from a central groove on each of the plurality of width members.

7. A customizable pallet, comprising:

a plurality of length members that includes a first circular projection defined along a top surface of the length member and a corresponding first circular groove defined along a bottom surface of the length member;

the first circular projection has a first portion and a second portion, the first portion extends outwardly from the length member, the second portion extends inwardly within the length member to a first circular holder positioned therein that secures the first circular projection; and a plurality of width members that includes a circular groove formed from a top surface to a bottom surface of the width member, the circular groove has a second circular holder positioned therein, the second circular holder having a second circular projection defined therein, wherein the first circular projection of the length member is aligned with the circular groove of the width member, which aligns the first circular holder on the second circular holder to form a connection.

8. The customizable pallet of claim 7, wherein the first circular holder is positioned at a predefined distance from the bottom surface of the length member.

9. The customizable pallet of claim 8, wherein the first portion of the first circular projection extends a predefined height from the top surface of the length member.

10. The customizable pallet of claim 7, wherein the top surface of the plurality of length members is arranged upon a bottom surface of the plurality of width members.

11. The customizable pallet of claim 10, wherein the plurality of length members and the plurality of width members are arranged such that the customizable pallet forms a shape of a triangle or trapezoid.

12. The customizable pallet of claim 7, wherein a length of the plurality of length members is predefined and a length of the plurality of width members is predefined.

13. The customizable pallet of claim 7, wherein the second circular holder is positioned at a predefined distance from the top surface of the width member.

* * * * *